US009243619B2

(12) United States Patent
Oshima et al.

(10) Patent No.: US 9,243,619 B2
(45) Date of Patent: Jan. 26, 2016

(54) LIQUID FEED PUMP AND CIRCULATION PUMP WITH DETECTION UNITS TO DETECT OPERATING STATES OF THE PUMPS

(75) Inventors: Atsushi Oshima, Shiojiri (JP); Takahiro Matsuzaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 456 days.

(21) Appl. No.: 13/606,781

(22) Filed: Sep. 7, 2012

(65) Prior Publication Data

US 2013/0064683 A1 Mar. 14, 2013

(30) Foreign Application Priority Data

Sep. 13, 2011 (JP) ..... 2011-199117
Sep. 13, 2011 (JP) ..... 2011-199118
Jun. 22, 2012 (JP) ..... 2012-140549

(51) Int. Cl.
*F04B 23/04* (2006.01)
*F04B 43/04* (2006.01)
*F04B 49/06* (2006.01)
*F04B 49/08* (2006.01)

(52) U.S. Cl.
CPC ..... *F04B 23/04* (2013.01); *F04B 43/046* (2013.01); *F04B 49/065* (2013.01); *F04B 49/08* (2013.01)

(58) Field of Classification Search
CPC ..... F04B 49/065; F04B 49/022; F04B 43/04; F04B 43/09; F04B 23/04; F04B 43/046; F04B 49/08; B41J 2/175; F02M 53/06; F02M 57/00; F02M 69/047
USPC ..... 417/44.2, 44.9, 412, 413.1, 413.2; 347/6, 7; 123/304, 549; 73/168, 19.1, 73/865.5
See application file for complete search history.

(56) References Cited

U.S. PATENT DOCUMENTS 4,649,886 A * 3/1987 Igashira ..... F02D 41/2096 123/357
6,375,299 B1 4/2002 Foster et al.
(Continued)

FOREIGN PATENT DOCUMENTS

JP 63-141750 6/1988
JP 2001-132646 5/2001
(Continued)

OTHER PUBLICATIONS

English Translation of Makino (JP 2006/078334 A), Dated Mar. 23, 2006.*
(Continued)

*Primary Examiner* — Justin Jonaitis
*Assistant Examiner* — Christopher Brunjes
(74) *Attorney, Agent, or Firm* — Workman Nydegger

(57) ABSTRACT

A pump chamber is connected to an outlet-side buffer chamber via an outlet channel, and pumps a liquid from the outlet-side buffer chamber. A pressure vibration generated within the pump chamber when the volume of the pump chamber is decreased includes various kinds of information relating to the operating states of the liquid feed pump, such as mixing of bubbles, pumping pressure, dissolved gas amount, and liquid feed amount. Thus, it is possible to detect the pressure vibration, thereby simply and easily detecting the various kinds of information relating to the operating states of the liquid feed pump.

17 Claims, 8 Drawing Sheets

(56) References Cited

U.S. PATENT DOCUMENTS

| | | | | |
|---|---|---|---|---|
| 6,709,240 | B1 * | 3/2004 | Schmalz | F04B 49/065 318/432 |
| 7,011,507 | B2 * | 3/2006 | Seto | F04B 43/046 417/307 |
| 7,396,511 | B2 | 7/2008 | Fujii et al. | |
| 7,901,374 | B2 * | 3/2011 | Seto | A61B 17/3203 604/131 |
| 8,337,452 | B2 | 12/2012 | Seto et al. | |
| 8,382,702 | B2 | 2/2013 | Uchida et al. | |
| 8,506,584 | B2 | 8/2013 | Seto et al. | |
| 8,652,091 | B2 | 2/2014 | Seto et al. | |
| 8,794,931 | B2 | 8/2014 | Takahashi | |
| 8,857,734 | B2 | 10/2014 | Kojima | |
| 2002/0098122 | A1 * | 7/2002 | Singh et al. | 422/100 |
| 2004/0013539 | A1 * | 1/2004 | Takagi | F04B 53/1077 417/300 |
| 2005/0019180 | A1 * | 1/2005 | Seto | F04B 43/046 417/413.1 |
| 2005/0159639 | A1 * | 7/2005 | Skliar | A61M 1/122 600/16 |
| 2007/0133968 | A1 * | 6/2007 | Kawamura et al. | 396/79 |
| 2010/0177147 | A1 * | 7/2010 | Kusunoki et al. | 347/70 |
| 2011/0112479 | A1 | 5/2011 | Tomoyama et al. | |
| 2011/0208224 | A1 | 8/2011 | Kojima | |
| 2011/0213396 | A1 | 9/2011 | Tabata et al. | |
| 2013/0052044 | A1 | 2/2013 | Matsuzaki et al. | |

FOREIGN PATENT DOCUMENTS

| | | | |
|---|---|---|---|
| JP | 2004-011535 | | 1/2004 |
| JP | 2004314459 | A * | 11/2004 |
| JP | 2006078334 | A * | 3/2006 |
| JP | 2008-082202 | | 4/2008 |
| JP | 2010-242764 | | 10/2010 |
| JP | 2011-103930 | | 6/2011 |
| JP | 2011-177330 | | 9/2011 |
| SU | 1185226 | A * | 10/1985 |
| SU | 1185226 | A1 * | 10/1985 |

OTHER PUBLICATIONS

Bakhtinov SU 1185226 A—English Abstract.*

Cheng, G et al.; "Ferroelectric Properties of BiFeO3 Thin Films Prepared via a Simple Chemical Solution Deposition" Ferroelectrics, Taylor & Francis Aug. 2010, vol. 406, pp. 1481-1486, 1588.

* cited by examiner

LIQUID FEED PUMP AND CIRCULATION PUMP WITH DETECTION UNITS TO DETECT OPERATING STATES OF THE PUMPS

BACKGROUND

1. Technical Field

The present invention relates to a liquid feed pump and a circulation pump that pump a liquid.

2. Related Art

A liquid feed pump is known that repeats the operation of increasing the volume of a pump chamber to suck a liquid, and decreasing the volume of the pump chamber to pump the liquid. In a small liquid feed pump, a small piezoelectric element that can generate a large force as an actuator for increasing and decreasing the volume of the pump chamber is frequently used (JP-A-2011-103930 or the like).

However, the liquid feed pump that increases and decreases the volume of the pump chamber has the following problems. First, if bubbles are mixed in the pump chamber, the bubbles are crushed even if the volume of the pump chamber is decreased. Thus, the liquid within the pump chamber cannot be pressurized, and the liquid cannot be fed. If gas, such as the air, is dissolved in a liquid to be fed, the compressibility of the liquid becomes higher. Thus, the pressure within the pump chamber when the volume of the pump chamber is decreased does not rise sufficiently, and the pumping pressure of the liquid drops. In order to avoid this, it is desirable to monitor the dissolved amount (dissolved gas amount) of the air or other gases dissolved in the liquid, but it is not easy to measure the dissolved gas amount. In addition, in a case where a channel for the liquid fed from the liquid feed pump is connected to the suction side of the liquid feed pump so as to form a circulation channel system (circulation device), the liquid fed to the liquid feed pump flows through a sealed channel. Thus, it is difficult to ascertain a liquid feed amount unless a flow rate sensor or the like is separately provided.

SUMMARY

An advantage of some aspects of the invention is to provide a technique capable of simply and easily detecting information (for example, any of mixing of bubbles, pumping pressure, dissolved gas amount, and liquid feed amount) on the operating states of a liquid feed pump.

An aspect of the invention is directed to a liquid feed pump that changes the volume of a pump chamber to pump a liquid in the pump chamber. The liquid feed pump includes an outlet channel connected to the pump chamber and having the liquid flowing therethrough from the pump chamber; an outlet-side buffer chamber having a larger compliance than the compliance of the pump chamber and having the liquid flowing therethrough from the outlet channel; a pressure detection unit that detects the internal pressure of the pump chamber; a comparison unit that compares the internal pressure detected in the pressure detection unit with a predetermined threshold, thereby producing and outputting a comparison signal; and an operating state detection unit that detects the operating state of the liquid feed pump, using the comparison signal output from the comparison unit.

In the liquid feed pump of the aspect of the invention having such a configuration, the liquid is sucked into the pump chamber if the volume of the pump chamber is increased. Thereafter, if the volume of the pump chamber is decreased, the liquid is fed from the outlet-side buffer chamber after the liquid is pumped to the outlet-side buffer chamber via the outlet channel from the pump chamber. Since the pump chamber and the outlet-side buffer chamber are connected via the outlet channel, these chambers constitute a resonance system. Here, the resonance system means a system that generates the pressure vibration for a while as a motive a change in the pressure when the pressure changes inside the system (an increase or decrease in pressure). In the system in which the pump chamber and the outlet-side buffer chamber are connected via the outlet channel, pressure fluctuation produced in any of the pump chamber, the outlet-side buffer chamber, and the outlet channel generates pressure vibration within the pump chamber, the outlet-side buffer chamber, and the outlet channel for a while after that. If the resonance system is configured by connecting the pump chamber and the outlet-side buffer chamber via the outlet channel, pressure vibration caused by resonance is generated in the pump chamber after the volume of the pump chamber is decreased. Thus, the internal pressure of the pump chamber is detected and compared with a predetermined threshold to produce a comparison signal, and the operating state of the liquid feed pump is detected on the basis of this comparison signal.

Although the details will be described below, in a case where the resonance system is configured by connecting the pump chamber and the outlet-side buffer chamber using the outlet channel, pressure vibration generated within the pump chamber by resonance accompanied by an increase or a decrease in the volume of the pump chamber includes various information relating to the operating states (for example, mixing of bubbles, pumping pressure, dissolved air amount, and liquid feed amount) of the liquid feed pump. Accordingly, it is possible to simply and easily detect information relating to the operating states of the liquid feed pump, using the comparison signal obtained by comparing the internal pressure of the pump chamber with the threshold.

In the liquid feed pump of the aspect of the invention, the internal pressure of the pump chamber may be detected in the following manner by changing the volume of the pump chamber, using the piezoelectric element. A current that flows to the piezoelectric element is detected. A difference between an integrated value obtained after the detected current is integrated and a drive waveform signal that becomes a base of a drive signal that drives the piezoelectric element may be used as the internal pressure of the pump chamber.

Since the volume of the pump chamber can be rapidly decreased with large force if the piezoelectric element is used, large pressure vibration caused by resonance can be generated. Since the internal pressure of the pump chamber can be detected from the current that flows to the piezoelectric element, it is not necessary to separately provide a pressure sensor or the like.

In the liquid feed pump of the aspect of the invention, the presence of bubbles mixed into the pump chamber may be detected on the basis of the presence of the comparison signal produced by pressure vibration generated within the pump chamber after the volume of the pump chamber is decreased.

In a case where bubbles are not present in the pump chamber, pressure vibration is generated within the pump chamber after the volume of the pump chamber is decreased. However, pressure vibration is not generated within the pump chamber in a case where bubbles are present. Accordingly, it is possible to simply and easily detect the presence of bubbles mixed into the pump chamber on the basis of whether or not the comparison signal has been detected after the volume of the pump chamber is decreased.

In the liquid feed pump of the aspect of the invention, the pressure (pumping pressure) under which the liquid is pumped from the liquid feed pump may be detected on the basis of the time until the comparison signal caused by pressure vibration within the pump chamber is detected after the volume of the pump chamber is decreased.

Although a detailed mechanism will be described below, the time until the comparison signal caused by pressure vibration within the pump chamber is detected after the volume of the pump chamber is decreased is determined by the pressure of the liquid within the outlet-side buffer chamber. The pressure of the liquid within the outlet-side buffer chamber becomes a pressure under which the liquid is pumped. Accordingly, it is possible to simply and easily detect the pumping pressure if the pumping pressure of the liquid is detected on the basis of the time until the comparison signal caused by pressure vibration within the pump chamber is detected after the volume of the pump chamber is decreased. In addition, since it is sufficient if the internal pressure of the pump chamber can be detected, it is possible to simply and easily detect the pumping pressure of the liquid, for example, even in a case where the liquid feed pump is assembled into a circulation channel system and the liquid flows through the interior of a sealed channel.

In the liquid feed pump of the aspect of the invention, a dissolved gas amount in the liquid may be detected on the basis of the frequency of the comparison signal detected by pressure vibration within the pump chamber after the volume of the pump chamber is decreased.

Although a detailed mechanism will be described below, the frequency of the comparison signal generated by pressure vibration within the pump chamber after the volume of the pump chamber is decreased has a strong correlation with the dissolved gas amount in the liquid. Accordingly, it is possible to simply and easily detect the dissolved gas amount in the liquid if the frequency of the comparison signal produced after the volume of the pump chamber is decreased is detected. In addition, since it is sufficient if the internal pressure of the pump chamber can be detected, it is possible to simply and easily detect the dissolved gas amount, for example, even in a case where the liquid feed pump is assembled into a circulation channel system and the liquid flows through the interior of a sealed channel.

In the liquid feed pump of the aspect of the invention, a liquid feed amount per time of the liquid may be detected on the basis of the frequency of the comparison signal detected by pressure vibration within the pump chamber after the volume of the pump chamber is decreased.

Although a detailed mechanism will be described below, the frequency of the comparison signal generated by pressure vibration within the pump chamber after the volume of the pump chamber is decreased has a strong correlation with the liquid feed amount per time of the liquid. Accordingly, it is possible to simply and easily detect the liquid feed amount in the liquid if the frequency of the comparison signal produced after the volume of the pump chamber is decreased is detected. In addition, since it is sufficient if the internal pressure of the pump chamber can be detected, it is possible to simply and easily detect the liquid feed amount, for example, even in a case where the liquid feed pump is assembled into a circulation channel system and the liquid flows through the interior of a sealed channel.

The invention may be understood as an aspect of a circulation channel including the above-described liquid feed pump; an inlet-side buffer chamber that is connected to the pump chamber of the liquid feed pump and causes the liquid to flow to the pump chamber; an inlet channel that is connected to the inlet-side buffer chamber and causes the liquid to flow into the inlet-side buffer chamber; and a fluid channel that is connected to the inlet channel and causes the liquid fed from the outlet-side buffer chamber to flow into the inlet channel.

In the circulation channel of the aspect of the invention, information relating to the operating states of the liquid feed pump (such as mixing of bubbles, the pumping pressure, the dissolved air amount and the liquid feed amount), can be detected using the comparison signal obtained by comparing the internal pressure of the pump chamber with the threshold. As a result, it is possible to realize a circulation channel capable of simply and easily detecting the information relating to the operating states of the liquid feed pump.

The liquid feed pump of the aspect of the invention can also be understood in the following aspect. That is, a liquid feed pump that changes the volume of a pump chamber to pump a liquid in the pump chamber is provided. The liquid feed pump includes an outlet channel connected to the pump chamber; an outlet-side buffer chamber having a larger compliance than the compliance of the pump chamber and connected to the pump chamber via the outlet channel so as to constitute a resonance system between the outlet-side buffer chamber and the pump chamber; a pressure detection unit that detects the internal pressure of the pump chamber after a decrease in the volume of the pump chamber; a comparison unit that compares the internal pressure detected in the pressure detection unit with a predetermined threshold, thereby outputting a comparison signal; and an operating state detection unit that detects the operating state of the liquid feed pump, using the comparison signal output from the comparison unit after a decrease in the volume of the pump chamber.

In the liquid feed pump of the aspect of the invention having such a configuration, the liquid is sucked into the pump chamber if the volume of the pump chamber is increased. Thereafter, if the volume of the pump chamber is decreased, the liquid is fed from the outlet-side buffer chamber after the liquid is pumped to the outlet-side buffer chamber via the outlet channel from the pump chamber. Since the pump chamber and the outlet-side buffer chamber are connected via the outlet channel, these chambers constitute a resonance system. For this reason, the pressure vibration caused by resonance is generated within the pump chamber after the volume of the pump chamber is decreased. Thus, the internal pressure of the pump chamber is detected and compared with a predetermined threshold to produce a comparison signal, and the operating state of the liquid feed pump is detected on the basis of this comparison signal.

In a case where the resonance system is configured by connecting the pump chamber and the outlet-side buffer chamber using the outlet channel, pressure vibration generated within the pump chamber by resonance accompanied by a decrease in the volume of the pump chamber includes various information relating to the operating states (for example, mixing of bubbles, pumping pressure, dissolved gas amount, and liquid feed amount) of the liquid feed pump. Accordingly, it is possible to simply and easily detect information relating to the operating states of the liquid feed pump, using the comparison signal obtained by comparing the internal pressure of the pump chamber with the threshold.

The liquid feed pump of the aspect of the invention can also be understood in the following aspect. That is, a liquid feed pump that changes the volume of a pump chamber to pump a liquid in the pump chamber is provided. The liquid feed pump includes an outlet channel connected to the pump chamber and having the liquid flowing therethrough from the pump chamber; an outlet-side buffer chamber having a larger compliance than the compliance of the pump chamber and having the liquid flowing therethrough from the outlet channel; a natural frequency measurement unit that measures the natural frequency from the pump chamber to the outlet channel; and a dissolved gas amount determination unit that determines a dissolved gas amount in the liquid on the basis of the natural frequency.

In the liquid feed pump of the aspect of the invention having such a configuration, the pump chamber is connected to the liquid channel via the outlet channel and the outlet-side buffer chamber, and if the volume of the pump chamber is changed, the liquid within the pump chamber is fed via the outlet channel and the outlet-side buffer chamber. Here, the outlet-side buffer chamber has a larger compliance than a pump chamber, and constitutes a resonance system between the pump chamber and the outlet channel. For this reason, if the volume of the pump chamber is changed for liquid feed, the pressure vibration caused by resonance is generated between the pump chamber, the outlet channel, and the outlet-side buffer chamber. Thus, the natural frequency of this pressure vibration is measured, and the dissolved gas amount in the liquid is determined on the basis of the obtained natural frequency.

Although the details will be described below, there is a strong correlation between the natural frequency of pressure vibration produced between the pump chamber, the outlet channel, and the outlet-side buffer chamber and the dissolved gas amount in the liquid, and the dissolved gas amount increases as the natural frequency becomes longer. For this reason, if the natural frequency is measured, the dissolved gas amount in the liquid can be determined. The natural frequency of the pressure vibration can be measured by various methods, such as using a pressure sensor, detecting the deformation of a wall surface of the pump chamber, the outlet channel or the outlet-side buffer chamber by the pressure vibration, or detecting a flow velocity change of the liquid in the outlet channel. For this reason, the dissolved gas amount in the liquid can be simply and easily determined. As a result, it is possible to avoid the performance of the liquid feed pump from degrading due to an increase in the dissolved gas amount in the liquid.

In the liquid feed pump of the aspect of the invention, the internal pressure of the pump chamber may be detected so as to measure the natural frequency.

In the vibration form of the pressure vibration generated between the pump chamber, the outlet channel, and the outlet-side buffer chamber, the portion of the outlet channel serves as a "knot of vibration". For this reason, in the portion of the outlet channel, pressure amplitude becomes smaller compared to the pump chamber or the outlet-side buffer chamber. Since the outlet-side buffer chamber has a larger compliance than the pump chamber, the pressure amplitude in the outlet-side buffer chamber becomes smaller compared to that of the pump chamber. Accordingly, if the internal pressure of the pump chamber is directly or indirectly detected by a method of providing a pressure sensor in the pump chamber, detecting the deformation of a wall surface of the pump chamber, or the like, it is possible to easily and simply measure the natural frequency of the pressure vibration.

In the liquid feed pump of the aspect of the invention, as a method for changing the volume of the pump chamber using the piezoelectric element, a current flowing to the piezoelectric element may be detected so as to measure the natural frequency.

Then, the natural frequency can also be measured using the piezoelectric element for changing the volume of the pump chamber. Particularly, since the pump chamber is small and it is difficult to load sensors or the like, it is possible to make the design of the pump chamber into a more preferable design if it is unnecessary to provide the sensors or the like.

In the liquid feed pump of the aspect of the invention, the dissolved gas amount is determined from the natural frequency using a strong correlation between the natural frequency of the pressure vibration generated from the pump chamber to the outlet channel and the dissolved gas amount in the liquid. However, if there is the strong correlation between the natural frequency and the dissolved gas amount, it is also possible to use the natural frequency itself as a substitute for the dissolved gas amount without determining the dissolved gas amount from the natural frequency. If this is taken into consideration, the liquid feed pump of the aspect of the invention can also be understood in the following configuration. That is, the liquid feed pump of the invention understood in another aspect is a liquid feed pump that changes the volume of a pump chamber, using a piezoelectric element, to pump a liquid in the pump chamber. The liquid feed pump includes an outlet channel connected to the pump chamber and having the liquid flowing therethrough from the pump chamber; an outlet-side buffer chamber having a larger compliance than the compliance of the pump chamber and having the liquid flowing therethrough from the outlet channel; a natural frequency measurement unit that detects a current flowing to the piezoelectric element, thereby measuring the natural frequency from the pump chamber to the outlet channel; and a drive signal adjustment unit that adjusts a drive signal to be applied to the piezoelectric element on the basis of the natural frequency.

In the liquid feed pump of the aspect of the invention understood in such a configuration, the natural frequency of the pressure vibration generated in the pump chamber, the outlet channel, and the outlet-side buffer chamber is measured, and the drive signal to be applied to the piezoelectric element is adjusted on the basis of the obtained natural frequency.

If the dissolved gas amount in the liquid changes as mentioned above, the natural frequency of the pressure vibration changes. Since the compressibility of the liquid becomes higher if the dissolved gas amount increases, the pressure in the pump chamber does not rise up sufficiently and the performance of the liquid feed pump degrades. That is, it is believed that the natural frequency is also strongly correlated with the performance of the liquid feed pump via the dissolved gas amount. Thus, if the natural frequency is measured, and the drive signal to be applied to the piezoelectric element is adjusted on the basis of the obtained natural frequency, a performance change in the liquid feed pump resulting from changes of the dissolved gas amount in the liquid can be corrected. Thus, it is possible to realize stable pump performance.

In the liquid feed pump of the aspect of the invention that adjusts the drive signal on the basis of the natural frequency, the amplitude of the drive signal may be adjusted on the basis of the natural frequency.

Then, even if the dissolved gas amount in the liquid increases, a rise in the pressure of the pump chamber becomes smaller, and thus, the liquid feed amount or the pumping pressure of the liquid feed pump drops, this can be compensated for by increasing the amplitude of the drive signal. Thus, stable pump performance can be secured.

In the liquid feed pump of the aspect of the invention that adjusts the drive signal on the basis of the natural frequency, the drive frequency (the number of times of drive signal output per time) of the drive signal may be adjusted on the basis of the natural frequency.

Then, even if the dissolved gas amount in the liquid increases, and the liquid feed amount of the liquid feed pump decreases, this can be compensated for by raising the drive frequency of the drive signal. Thus, stable pump performance can be secured.

The liquid feed pump of the aspect of the invention can also be understood as the following configuration. That is, the liquid feed pump of the aspect of the invention understood in another aspect may be understood as a liquid feed pump that changes the volume of a pump chamber to pump a liquid in the pump chamber. The liquid feed pump includes an outlet channel connected to the pump chamber and having the liquid flowing therethrough from the pump chamber; an outlet-side buffer chamber having a larger compliance than the compliance of the pump chamber and having the liquid flowing therethrough from the outlet channel; a natural frequency measurement unit that measures the natural frequency from the pump chamber to the outlet channel; and a notification signal output unit that outputs a notification signal in a case where the natural frequency exceeds a predetermined value.

In the liquid feed pump of the aspect of the invention understood in such another aspect, the natural frequency of pressure vibration generated in the pump chamber, the outlet channel, and the outlet-side buffer chamber is measured, and if the obtained natural frequency exceeds a predetermined value, a predetermined notification signal is output.

Then, if the dissolved gas amount in the liquid changes and the performance (liquid feed amount, pumping pressure, or the like) of the liquid feed pump degrades, the notification signal is output. Thus, degradation in the performance of the liquid feed pump can be immediately recognized. As a result, since maintenance tasks, such as replacing the liquid or deaerating the liquid, can be performed, stable liquid feed pump performance can be maintained.

Additionally, an aspect of the invention may be configured as a circulation device including a liquid channel connected so as to feed the liquid fed from the liquid feed pump to the pump chamber, using the liquid feed pump of the aspect of the invention.

In such a circulation device, in order to avoid degradation of the performance of the liquid feed pump caused by an increase in dissolved gas amount in the liquid, the liquid can be continuously circulated.

BRIEF DESCRIPTION OF THE DRAWINGS

The invention will be described with reference to the accompanying drawings, wherein like numbers reference like elements.

DESCRIPTION OF EXEMPLARY EMBODIMENTS

In the following, in order to clarify the contents of the present invention described above, an example will be described according to the following order.

A. Apparatus Configuration:
B. Output Example of Pressure Detection Unit and Comparison Unit:
C. Detection Method of Bubbles:
D. Detection Method of Pumping Pressure:
E. Detection Method of Dissolved gas amount and Liquid Feed Amount:
F. Modification Example:

A. Apparatus Configuration

Figure 1:
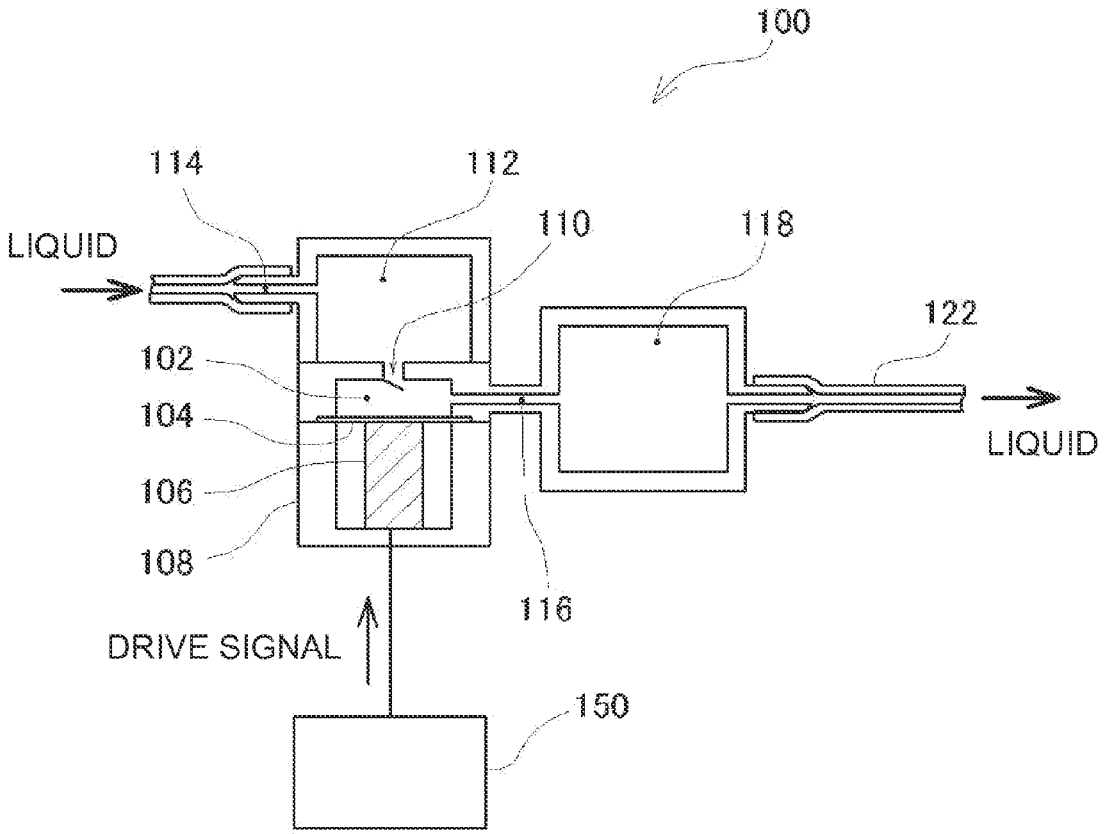
FIG. 1 is an explanatory view showing the configuration of a liquid feed pump of the present example.

FIG. 1 is an explanatory view showing the configuration of a liquid feed pump 100 of the present example. In the liquid feed pump 100 of the present example, a portion of a pump chamber 102 is formed by a diaphragm 104, a piezoelectric element 106 is received in a casing 108, and an inlet-side buffer chamber 112 is provided in an upper part of the pump chamber 102 via a check valve 110. A liquid is supplied to the inlet-side buffer chamber 112 from an inlet channel 114. The pump chamber 102 is connected to an outlet-side buffer chamber 118 via an outlet channel 116, and a fluid channel 122 is connected to the outlet-side buffer chamber 118. Moreover, since a drive circuit 150 is connected to the piezoelectric element 106, a drive signal can be applied to the piezoelectric element 106 from the drive circuit 150.

In the shown liquid feed pump 100, if a drive signal is applied to the piezoelectric element 106 so as to elongate the piezoelectric element 106, the diaphragm 104 deforms and the volume of the pump chamber 102 decreases. Then, the liquid within the pump chamber 102 flows into the outlet-side buffer chamber 118 via the outlet channel 116, and is fed to the fluid channel 122 from the outlet-side buffer chamber 118. Here, the drive circuit 150 of the present example has the functions of not only applying a drive signal to the piezoelectric element 106 but also detecting the internal pressure of the pump chamber 102 and acquiring various kinds of information on the operating state of the liquid feed pump 100.

Figure 2:
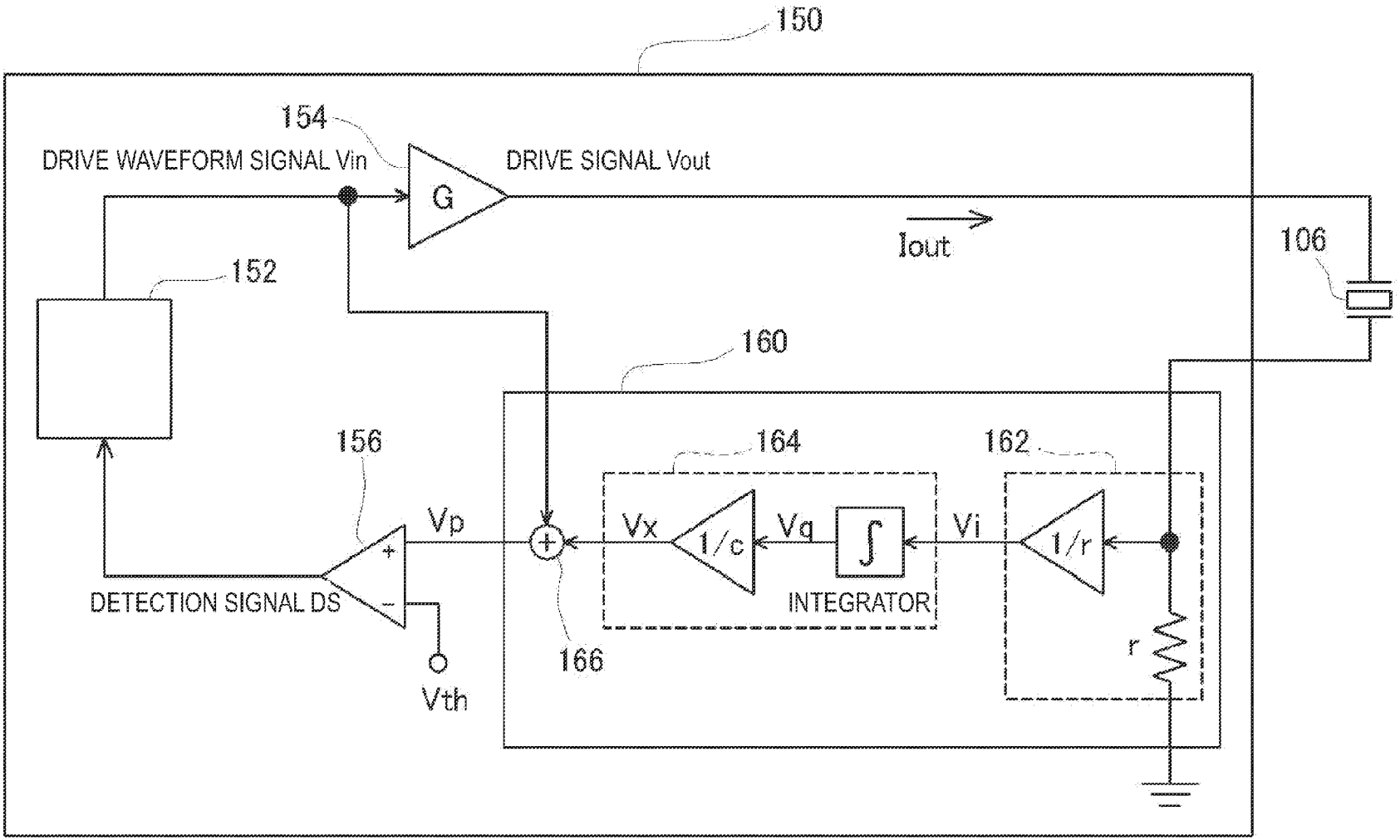
FIG. 2 is an explanatory view showing the schematic configuration of a drive circuit of the present example.

FIG. 2 is an explanatory view showing the schematic configuration of the drive circuit 150 of the present example. As shown in the drawing, the drive circuit 150 of the present example includes a control unit 152 that outputs a drive waveform signal Vin, an amplifying circuit 154 that amplifies the drive waveform signal Vin with an amplification factor G to output a drive signal Vout, a pressure detection unit 160 that detects the internal pressure of the pump chamber 102 to output a pressure signal Vp, a comparison unit 156, such as an op amp comparator, that compares the detected internal pressure with a predetermined threshold, and the like. The pressure detection unit 160 is constituted by a current detection circuit 162 that detects a drive current of the piezoelectric element 106, an integrating circuit 164 that integrates the detected drive current, a subtraction circuit 166 that outputs a difference between the output of the integrating circuit 164 and the drive waveform signal Vin, and the like.

The drive circuit 150 of the present example shown in FIG. 2 detects the pressure signal Vp indicating the internal pressure of the pump chamber 102 as follows. If the drive waveform signal Vin is amplified in the amplifying circuit 154 and it is applied to the piezoelectric element 106 as the drive signal Vout, a drive current Iout flows into the piezoelectric element 106. A resistor r for current detection is connected to the other end of the piezoelectric element 106, and is grounded via the resistor r. The current detection circuit 162 detects a voltage generated by the resistor r, divides the voltage by the resistance value of the resistor r, thereby converting the voltage into a current signal Vi, and then, outputs the current signal to the integrating circuit 164. The integrating circuit 164 integrates the received current signal Vi in an integrator, thereby converting the current signal into a charge signal Vq corresponding to the amount of charges stored in the piezoelectric element 106.

Here, since the drive current Iout (current signal Vi) that flows into the piezoelectric element 106 is proportional to the displacement rate of the piezoelectric element 106, the amount of charges (charge signal Vq) stored in the piezoelectric element 106 is proportional to the displacement of the piezoelectric element 106. The displacement of the piezoelectric element 106 is approximately proportional to a drive signal, in a state where the piezoelectric element 106 can freely elongate and contract (state where the piezoelectric element does not receive pressure in the elongation/contraction direction). However, if the internal pressure changes in the pump chamber 102, the piezoelectric element 106 receives a change in the pressure via the diaphragm 104. At this time, since the piezoelectric element 106 elongates and contracts in proportion to the received change in the pressure (the displacement changes), the difference with the piezoelectric element 106 at its original displacement (displacement in a state where the piezoelectric element does not receive pressure) is proportional to the pressure (internal pressure of the pump chamber 102) that the piezoelectric element 106 has received. Thus, the pressure signal Vp corresponding to the internal pressure of the pump chamber 102 can be obtained by dividing the charge signal Vq obtained in the integrator by the equivalent electrostatic capacitance c of the piezoelectric element 106 and the amplification factor G of the amplifying circuit 154, thereby obtaining a voltage signal Vx corresponding to an actual displacement of the piezoelectric element 106, and obtaining the difference between the voltage signal Vx and the drive waveform signal Vin in the subtraction circuit 166. By inputting the pressure signal Vp obtained in this way to the comparison unit 156 and comparing the pressure signal with a predetermined threshold, a binarized detection signal DS is produced, and is input to the control unit 152. The control unit 152 acquires various kinds of information on the operating state of the liquid feed pump 100 on the basis of the input detection signal DS. A method of acquiring information on an operating state on the basis of the detection signal DS will be described below in more detail. In the example, the control unit 152 corresponds to the "operating state detection unit" in the invention.

B. Output Example of Pressure Detection Unit and Comparison Unit

Figure 3A:
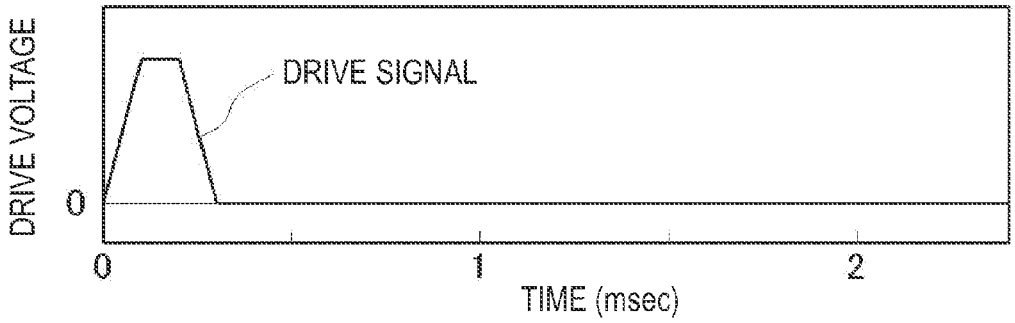
FIGS. 3A to 3C are explanatory views illustrating a pressure signal and a detection signal that are obtained when a drive signal is applied to a piezoelectric element.
Figure 3B:
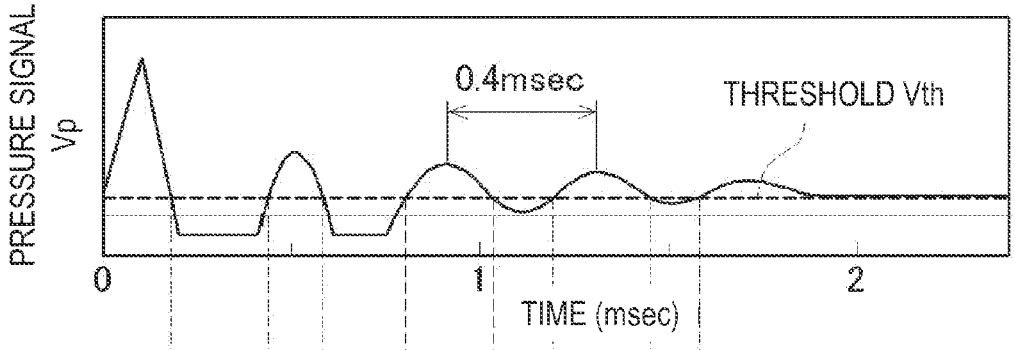
Figure 3C:
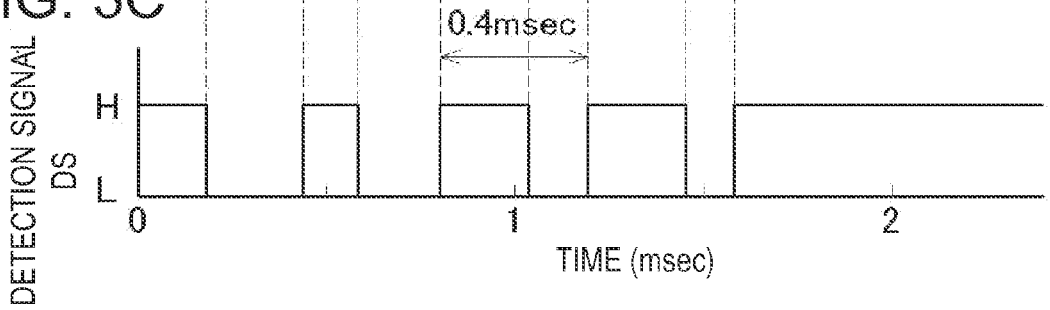

FIGS. 3A to 3C are explanatory views illustrating the pressure signal Vp obtained in the pressure detection unit 160 and the detection signal DS obtained in the comparison unit 156, when the drive signal Vout is applied to the piezoelectric element 106. The drive signal Vout applied to the piezoelectric element 106 is shown in FIG. 3A, the pressure signal Vp obtained in the integrating circuit 164 is shown in FIG. 3B, and the detection signal DS obtained in the comparison unit 156 is shown in FIG. 3C.

For example, as shown in FIG. 3B, a drive signal of one pulse is applied. Since the piezoelectric element 106 elongates if the voltage (drive voltage) of a drive signal rises, the volume of the pump chamber 102 decreases. As a result, as shown in FIG. 3B, the moment the voltage of the drive signal rises up, and the internal pressure of the pump chamber 102 rises rapidly. While the voltage of the drive signal is maintained at a maximum voltage, the displacement of the piezoelectric element 106 does not change. For this reason, the internal pressure of the pump chamber 102 decreases as the liquid flows out of the pump chamber 102. At this time, since an inertia force acts on the liquid that passes through the outlet channel 116 due to the inertance of the outlet channel 116, the internal pressure of the pump chamber 102 becomes a negative pressure. In the example, since the voltage of the drive signal falls while the internal pressure of this pump chamber 102 is brought to a negative pressure, the displacement of the piezoelectric element 106 is shortened. Although the drive signal is not changing after that as shown in FIG. 3B, the internal pressure of the pump chamber 102 vibrates in a fixed frequency. Corresponding to this, as shown in FIG. 3C, not only a pulse corresponding to a rise in the internal pressure accompanied by application of the drive signal but a pulse corresponding to subsequent vibration of the internal pressure are generated in the detection signal DS.

Generation of such pressure vibration is based on the following mechanism. First, as the drive signal is applied, the piezoelectric element 106 elongates and the internal pressure of the pump chamber 102 rises rapidly. At this time, since the outlet-side buffer chamber 118 is located between the outlet channel 116 and the fluid channel 122, the liquid pressurized in the pump chamber 102 moves to the outlet-side buffer chamber 118, and the internal pressure of the pump chamber 102 drops immediately. If this phenomenon is seen from the pump chamber 102 side, the fluid channel 122 that is present on the other side of the outlet-side buffer chamber 118 hardly affect the pump chamber 102 because the outlet-side buffer chamber 118 is present, and is brought to the same state as the outlet channel 116 being simply connected. For this reason, when the volume of the pump chamber 102 tends to decrease and the liquid of the volume equivalent to the volume decrease (excluded volume) tends to flow out, since only the channel resistance and inertance of the outlet channel 116 are affected, the time required for allowing the liquid equivalent to the excluded volume to flow becomes short. Since an inertia force works on the liquid that has moved through the outlet channel 116 by the inertance of the outlet channel 116, the internal pressure of the pump chamber 102 becomes a negative pressure, and it is possible to supply the liquid from the inlet-side buffer chamber 112 to the pump chamber 102. At this time, since the inertance of the outlet channel 116 is larger compared to the inertance of a communication passage between the inlet-side buffer chamber 112 and the pump chamber, the liquid that moves through the outlet channel 116 hardly returns to the pump chamber 102, and the liquid of the inlet-side buffer chamber 112 is exclusively supplied to the pump chamber 102. This is due to the fact that the inertance of a channel (passage portion where the check valve 110 is provided) on the inlet side is significantly small compared to the inertance of a channel (outlet channel 116) on the outlet-side.

Here, the inertance is the characteristic value of a channel, and indicates the easiness of flow of a fluid in a case where the fluid within the channel tends to flow as pressure is applied to the end of the channel. For example, as a simplest case, a fluid (hereinafter referred to as a liquid) of density ρ is filled into a channel of which the cross-sectional area is S and the length is L, and pressure P (precisely, a pressure differential P at both ends) is applied to one end of the channel. pressure P×cross-sectional area S acts on the fluid within the channel, and as a result, the fluid within the channel flows out. If the acceleration of the fluid at that time is a, since the mass of the fluid within the channel is density ρ×cross-sectional area S×length L, if an equation of motion is written and modified, the following equation is obtained.

$$P=\rho\times L\times a \tag{1}$$

If the volumetric flow rate of the fluid that flows through the channel is Q and the flow velocity of the fluid that flows through the channel is v, the following is established because of Q=v×S.

$$dQ/dt=a\times S \tag{2}$$

If Equation (2) is substituted into Equation (1), the following equation is set up.

$$P=(\rho\times L/S)\times(dQ/dt) \tag{3}$$

This equation is an equation obtained by expressing the equation of motion regarding the fluid within the channel using the pressure P (precisely, pressure differential at both ends) applied to one end of the channel, and dQ/dt. Equation (3) shows that dQ/dt becomes larger (that is, the flow velocity changes greatly) as (ρ×L/S) becomes smaller, if the same pressure P is applied. This (ρ×L/S) is a value referred to as the inertance.

In the liquid feed pump 100 of the present example shown in FIG. 1, the inertance of the outlet channel 116 has a large value because the internal diameter is small and the passage length is long. In contrast, since the passage length of the passage portion provided with the check valve 110 is short, the inertance of the channel on the inlet side of the pump chamber 102 has a small value. For this reason, when the pump chamber 102 has a negative pressure, the liquid on the outlet side with a large synthetic inertance is rarely sucked, and the liquid on the inlet side with a small synthetic inertance is exclusively sucked into the pump chamber 102.

On the other hand, since the liquid that has flowed into the outlet-side buffer chamber 118 does not flow out easily because the channel resistance of the fluid channel 122 is high, the internal pressure of the outlet-side buffer chamber 118 rises up. Since the internal pressure of the pump chamber 102 drops at this time, the inertia force of the liquid within the outlet channel 116 decreases gradually. Since no check valve is provided between the pump chamber 102 and the outlet-side buffer chamber 118, the backflow to the pump chamber 102 from the outlet-side buffer chamber 118 occurs soon. Since the liquid does not flow into the inlet-side buffer chamber 112 by virtue of the check valve 110 even if the liquid flows back to the pump chamber 102, the internal pressure of the pump chamber 102 rises again, and the liquid that has flowed back flows out toward the outlet-side buffer chamber 118. Thereby, the pump chamber 102 has a negative pressure, so that it is possible to further supply the liquid to the pump chamber 102 from the inlet-side buffer chamber 112. By repeating such vibration, the check valve is opened multiple times (twice in the example shown in FIGS. 3A to 3C) per one drive, so that it is possible to supply the liquid to the pump chamber 102.

This phenomenon usually tends to be understood to be the propagation caused by pressure waves in the liquid that propagate between the pump chamber 102 and the outlet-side buffer chamber 118. However, in the liquid feed pump 100 of the present example, the distance between the pump chamber 102 and the outlet-side buffer chamber 118 is short (about 10 cm (centimeters) no matter how long it is), and a frequency according to the propagation of the pressure waves is to be 0.2 msec (milliseconds) even at the maximum even if the sound speed in the liquid is about 1000 m/sec (meters/second). However, the natural frequency of the vibration shown in FIG. 3B becomes about 0.4 msec, and cannot be described by the propagation of the pressure waves.

However, this phenomenon can be described by taking the compressibility of the liquid into consideration (treat the liquid as a compressible fluid). That is, if the compliance of the pump chamber 102, the inertance of the outlet channel 116, and the resonance formed by the compliance of the outlet-side buffer chamber 118 are taken into consideration, the natural frequency T can be expressed by the following Equation (4).

$$T=2\pi(MC)^{1/2} \tag{4}$$

Here, M is an inertance of the outlet channel 116, and C is the synthetic compliance of the pump chamber 102 and the outlet-side buffer chamber 118. If the compliance of the pump chamber 102 is $C_1$ and the compliance of the outlet-side buffer chamber 118 is $C_2$, the synthetic compliance C is given by the following Equation (5).

$$C=1/\{1/C_1+1/C_2\} \tag{5}$$

If the resonance having the natural frequency T of the above Equation (4) is assumed, it is possible to describe the phenomenon in which the internal pressure of the pump chamber 102 shown in FIG. 3B vibrates.

Here, the compliance indicates the expansion of volume or the compression of a fluid caused by the deformation of a fluid chamber when pressure is applied to the interior of the fluid chamber. For example, as a simplest case, a fluid chamber of which the volume is V and the volume elasticity modulus is K is filled with a fluid of compressibility $\kappa_F$ (Hereinafter, referred to as a liquid), and the pressure P is applied to the liquid within the fluid chamber. At this time, the variation ΔV1 of the volume caused by the deformation of the fluid chamber becomes $$\Delta V1=V/K\times P \tag{6}$$

The variation ΔV2 of the volume caused by the compression of the liquid is $$\Delta V2=V\times\kappa_F\times P \tag{7}$$

The variation ΔV of the volume of the apparent fluid chamber with respect to the pressure P is $$\Delta V=V\times(1/K+\kappa_F)\times P \tag{8}$$

and this $V\times(1/K+\kappa_F)$ is a value referred to as compliance. Here, when the fluid chamber is a member with the same elasticity modulus and the liquid is a fluid with the same compressibility, if the same pressure P is applied, Equation (8) shows that the variation ΔV of the volume of the apparent fluid chamber is proportional to the volume V of the fluid chamber.

It is expected from Equations (4) and (5) that the natural frequency T will change depending on the compliance (volume) of the pump chamber 102 or the compliance (volume) of the outlet-side buffer chamber 118, and such a phenomenon is actually confirmed. In the example, various kinds of information on the operating state of the liquid feed pump 100 are detected after such pressure vibration is converted into the detection signal DS.

C. Detection Method of Bubbles

Figure 4A:
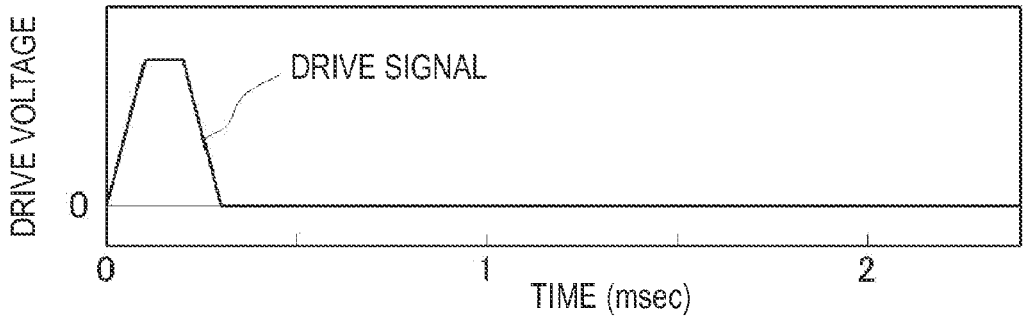
FIGS. 4A to 4C are explanatory views illustrating a pressure signal and a detection signal that are obtained when bubbles are present in a pump chamber.
Figure 4B:
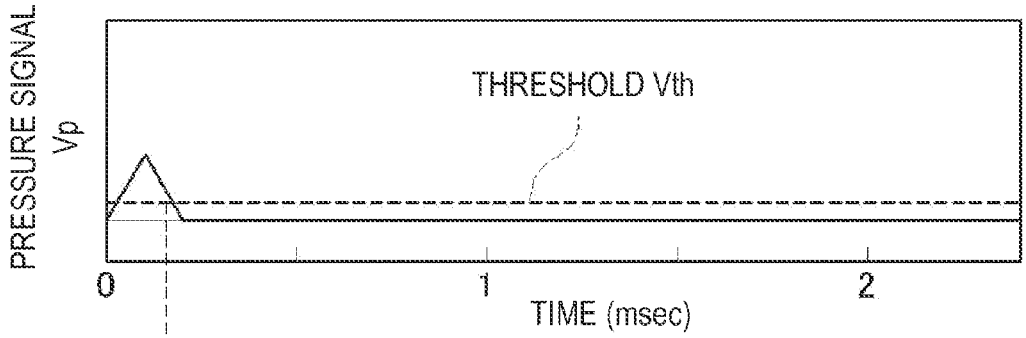
Figure 4C:
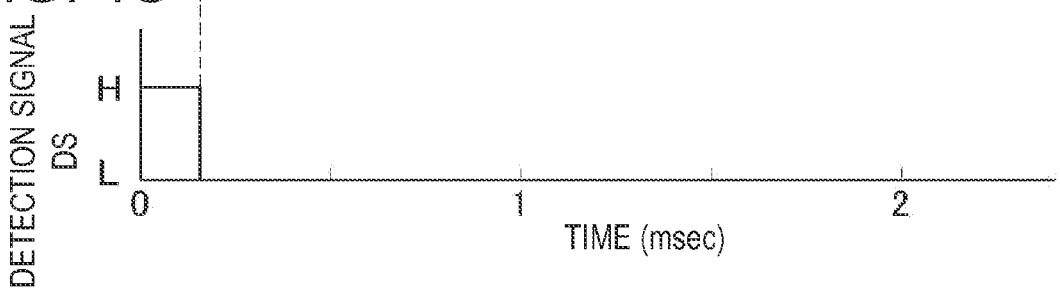

FIGS. 4A to 4C are an explanatory view illustrating the pressure signal Vp obtained in the pressure detection unit 160 and the detection signal DS obtained in the comparison unit 156, when bubbles are present in the pump chamber 102. The drive signal Vout applied to the piezoelectric element 106 is shown in FIG. 4A, the pressure signal Vp is shown in FIG. 4B, and the detection signal DS is shown in FIG. 4C.

As is clear from the comparison with the case where bubbles are present as shown in FIG. 3A to 3C, in a case where bubbles are not present in the pump chamber 102, the internal pressure of the pump chamber 102 rises up as a drive signal is applied to the piezoelectric element 106. However, the displacement of the piezoelectric element 106 is absorbed by the compression of bubbles, and the amount of rise in the internal pressure decreases. For this reason, the pressure vibration caused by the above-described resonance between the pump chamber 102, the outlet channel 116, and the outlet-side buffer chamber 118 is hardly generated. That is, although the rise and drop in the internal pressure accompanied by raising the voltage of the drive signal (in the following, this is referred to as a first wave) can be observed in any of FIGS. 3B and 4B, whereas the pressure vibrations caused by the subsequent resonances (in the following, these are referred to as a second wave, a third wave, and a fourth wave in order from front) are hardly generated in FIG. 4B where bubbles are present. As a result, although the pulse of the detection signal DS corresponding to the first wave is generated in any of FIGS. 3C and 4C, whereas neither pulse corresponding to the subsequent second wave nor pulse corresponding to the third wave is seen in FIG. 4C where bubbles are present. In the following, the pulse of the detection signal DS corresponding to the first wave is referred to as a first pulse, a pulse corresponding to the second wave is referred to as a second pulse, a pulse corresponding to the third wave is referred to as a third pulse, and a pulse corresponding to the fourth wave is referred to as a fourth pulse. Accordingly, it is possible to determine that there is no bubble in the pump chamber 102 if the second pulse can be detected, and on the contrary, bubbles are present in the pump chamber 102 if the second pulse cannot be detected.

Since the wave height of the first wave becomes low if bubbles are present within the pump chamber 102, it is possible to discriminate the presence of bubbles even by setting a suitable threshold in advance and comparing the internal pressure (that is, the pressure signal Vp) with the threshold of the pump chamber 102. However, in this method, it is determined that bubbles are present in a case where the peak value of the first wave has decreased to a certain degree, and determination accuracy is dependent on whether or not it is determined that bubbles have been generated if the peak value decreases to a certain degree (that is, setting of a threshold). In contrast, in the method of the present example described above, it is possible to discriminate the presence of bubbles with high accuracy because it can be determined on the basis of whether or not the second pulse based on the second wave has occurred.

D. Detection Method of Pumping Pressure

As illustrated in FIG. 3C, in a case where the second pulse is detected following the first pulse of the detection signal DS, the length of time until the second pulse is generated after the first pulse is generated has information on the pressure (exactly, the pressure in the outlet-side buffer chamber 118) under which the liquid feed pump 100 pumps the liquid. This is because, as described above, the first pulse of the detection signal DS is a pulse corresponding to the first wave of the pressure signal Vp and the second pulse is a pulse corresponding to the second wave. As mentioned above with reference to FIGS. 3A to 3C, the second wave of the pressure signal Vp is generated as the liquid, which flows through the interior of the outlet channel 116 from the pump chamber 102 toward the outlet-side buffer chamber 118, is pulled back into the pump chamber 102 due to the pressure differential between the pump chamber 102 and the outlet-side buffer chamber 118. Accordingly, if the pressure differential between the pump chamber 102 and the outlet-side buffer chamber 118 becomes large, the second wave is early generated, and accordingly the second pulse is also generated early because the force that pulls back the liquid within the outlet channel 116 becomes large.

A period until the second wave is generated after the first wave ends (the pressure signal Vp returns to its initial level) is a period until the liquid, which has flowed out of the pump chamber 102 toward the outlet-side buffer chamber 118, is pushed back and returned from the outlet-side buffer chamber 118. Accordingly, the interior of the pump chamber 102 until the second wave is generated has an approximately negative pressure. Since the pump chamber 102 is connected with the inlet-side buffer chamber 112 via the check valve 110, the pressure of the pump chamber 102 does not fluctuate greatly in the period until the second wave is generated. For this reason, the pressure differential between the pump chamber 102 and the outlet-side buffer chamber 118 in a period (in the following, this period is referred to as a negative pressure period) until the second wave is generated after the first wave ends is mainly determined by the pressure within the outlet-side buffer chamber 118. That is, if the pressure within the outlet-side buffer chamber 118 is high, the negative pressure period becomes short. In other words, if the negative pressure period is short, it can be said that the pressure within the outlet-side buffer chamber 118 is high. Moreover, it is confirmed by experiments that the time until the first wave ends after the first wave is generated (pulse width of the first pulse) hardly changes. Accordingly, as for the time until the second wave (second pulse) is generated after the first wave (the first pulse) is generated, it can also be said that the time becomes shorter as the pressure within the outlet-side buffer chamber 118 is higher.

Figure 5:
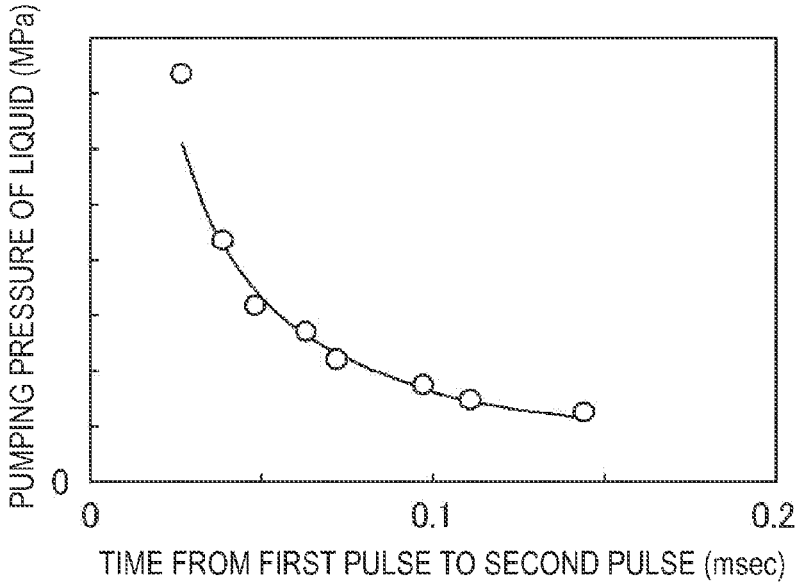
FIG. 5 is measurement results showing the relationship between a time from a first pulse to a second pulse and the pressure within an outlet-side buffer chamber.

FIG. 5 is measurement results showing the relationship between the time from the first pulse to the second pulse and the pressure within an outlet-side buffer chamber 118. In the example shown in FIG. 5, the time from the end of the first pulse to the generation of the second pulse is measured as the time from the first pulse to the second pulse. However, almost the same tendency is established even in a case where the time from the generation of the first pulse to the generation of the second pulse is used.

If the pressure within the outlet-side buffer chamber 118 (accordingly, the pressure with which the liquid is pumped to the fluid channel 122) becomes low as shown in FIG. 5, the time from the first pulse to the second pulse becomes long. For this reason, in a case where the second pulse is detected following the first pulse of the detection signal DS, the liquid feed pump 100 can detect the time from the first pulse to the second pulse, thereby detecting the pressure (pumping pressure) with which the liquid is pumped. That is, in a case where the time of the threshold is set in advance and the detected time becomes longer than the time of the threshold, it can be determined that the pumping pressure of the liquid has dropped. Alternatively, the pumping pressure can also be detected by storing the relationship (relationship between the detection time and the pumping pressure) as shown in FIG. 5 as a look-up table within the control unit 152, and by referring to this look-up table.

Figure 6:
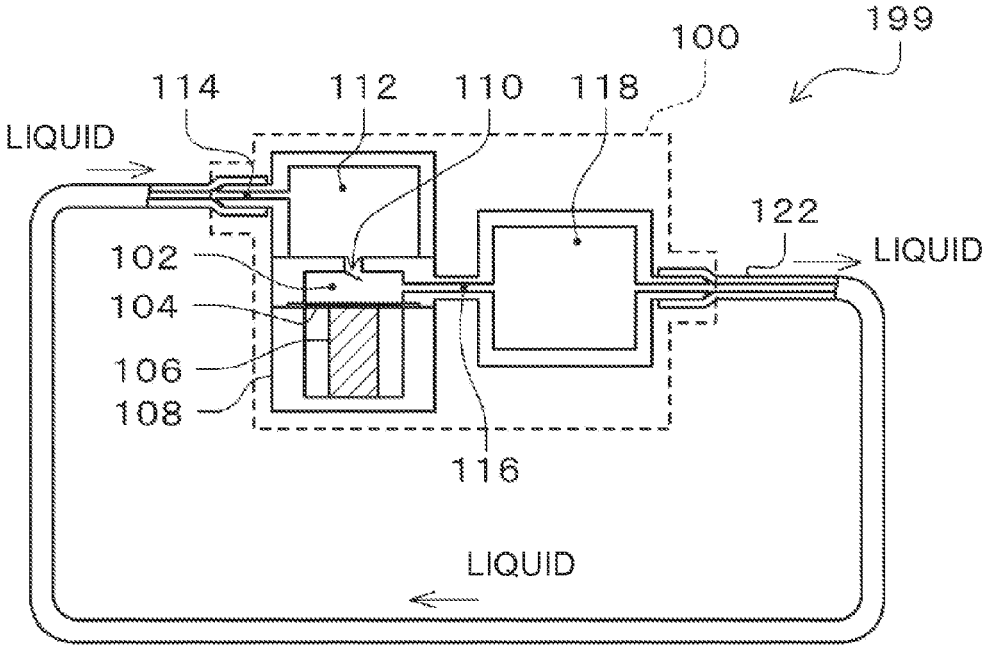
FIG. 6 is an explanatory view illustrating a circulation channel system formed using the liquid feed pump.

As illustrated in FIG. 6, in a case where a circulation channel is configured by refluxing the liquid that flows through the fluid channel 122 to the inlet channel 114, it is hard to notice that the pumping pressure drops because the liquid flows through a sealed channel. In this respect, in the example, the pressure within the outlet-side buffer chamber 118 can be monitored by detecting the time from the first pulse to the second pulse. Thus, it is possible to immediately recognize that the pumping pressure has dropped.

E. Detection Method of Dissolved Gas Amount and Liquid Feed Amount

As illustrated in FIG. 3C, in a case where the third pulse and the fourth pulse of the detection signal DS are detected, it is possible to detect the time until the fourth pulse is generated after the third pulse is generated, thereby detecting the dissolved amount (dissolved gas amount) of gas, such as the air that dissolves in the liquid. This is based on the following reasons.

First, the natural frequency T of the resonance that the pump chamber 102 and the outlet-side buffer chamber 118 generate via the outlet channel 116 is expressed by the aforementioned Equation (4). The synthetic compliance C that appears in Equation (4) is expressed by the aforementioned Equation (5). The compliance $C_1$ (compliance of the pump chamber 102) and the compliance $C_2$ (compliance of the outlet-side buffer chamber 118) that appear in Equation (5) are given by the following Equations, respectively, using Equation (8).

$$C_1=V_1\times(1/K+\kappa_F) \tag{9}$$

$$C_2=V_2\times(1/K+\kappa_F) \tag{10}$$

Here, $V_1$ is the volume of the pump chamber 102, and $V_2$ is the volume of the outlet-side buffer chamber 118. In the example, the pump chamber 102, and the outlet channel 116 and the outlet-side buffer chamber 118 are constituted by significantly hard members, such as stainless steel, and the elastic modulus K is very large, and in Equations (9) and (10), a change in the volume of the pump chamber 102 or the outlet-side buffer chamber 118 is almost neglected. If Equations (9) and (10) are substituted in Equations (4) and (5) and are arranged, it can be seen that the natural frequency T is proportional to the square root of the compressibility $\kappa_F$ of the liquid. Since the compressibility $\kappa_F$ of the liquid becomes higher as the dissolved amount of the gas within the liquid increases, it is believed that, as the dissolved amount of the gas within the liquid increases, the natural frequency T becomes longer. Since the compressibility $\kappa_F$ of the liquid becomes higher if the dissolved amount of the gas within the liquid increases, it is believed that it is impossible to effectively pressurize the liquid in the pump chamber 102 and the liquid feed amount of the liquid feed pump 100 decreases. Thus, the liquid feed amount and the natural frequency T of the liquid feed pump 100 were actually measured, while changing the dissolved gas amount within the liquid.

Figure 7:
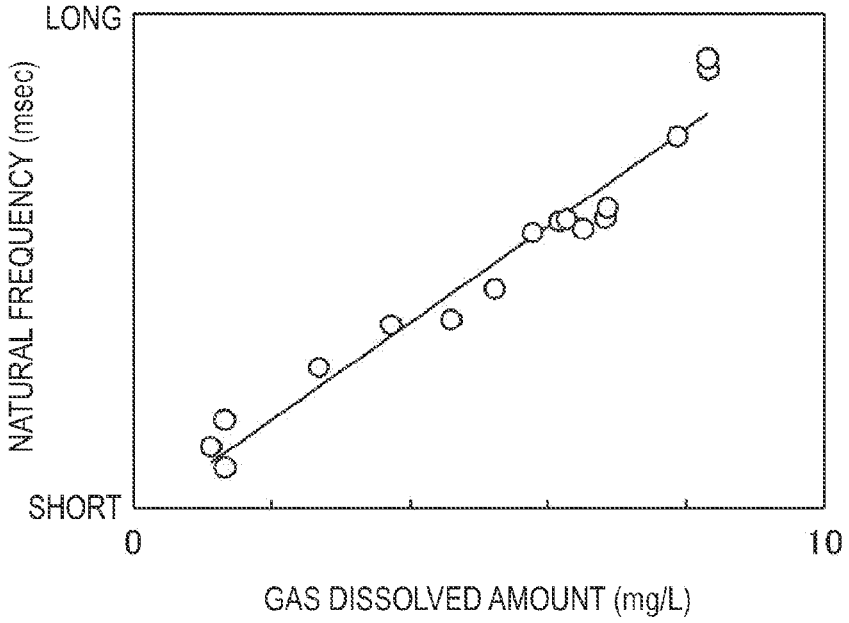
FIG. 7 is an explanatory view showing a relationship between a dissolved gas amount in the liquid and a natural frequency that are obtained by actual measurement.

FIG. 7 is an explanatory view showing the relationship between the dissolved gas amount in the liquid and the natural frequency T that are obtained by actual measurement. As shown in FIG. 7, the natural frequency T becomes longer as the dissolved gas amount increases. Since the natural frequency T is equivalent to the time until the fourth pulse is detected after the third pulse of the detection signal DS is detected, it is possible to detect the time until the fourth pulse is generated after the third pulse is generated, thereby detecting the dissolved amount (the dissolved gas amount) of gas, such as the air that dissolves in the liquid. In the example, the control unit 152 corresponds to a "natural frequency measurement unit" and a "dissolved gas amount determination unit" in the invention.

Figure 8:
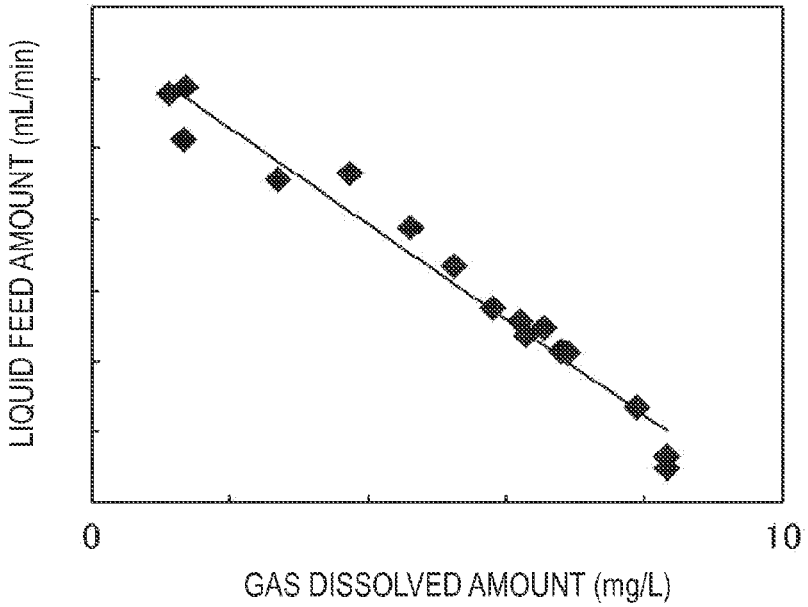
FIG. 8 is an explanatory view showing a relationship between a dissolved gas amount in the liquid and a liquid feed amount that are obtained by actual measurement.
Figure 9:
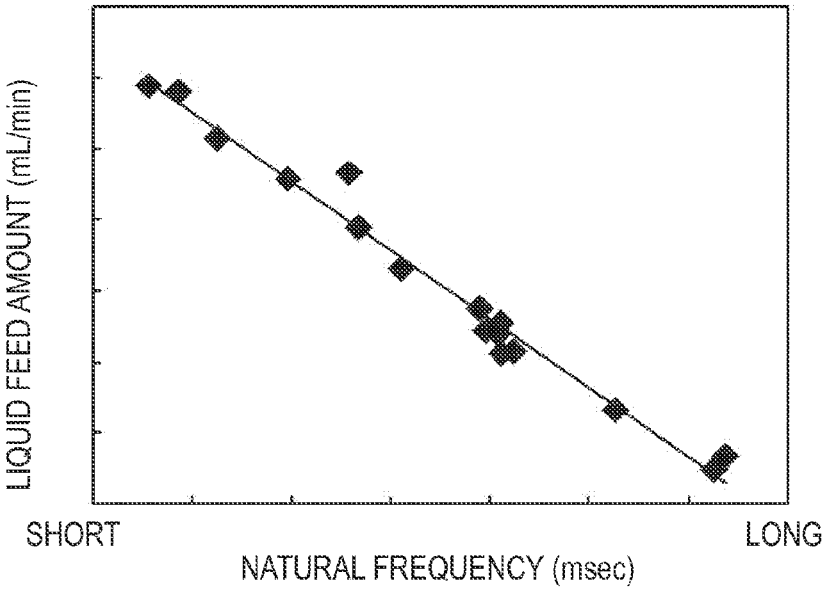
FIG. 9 is an explanatory view showing the relationship between a natural frequency and a liquid feed amount that are obtained by actual measurement.

FIG. 8 is an explanatory view showing the relationship between the dissolved gas amount in the liquid and the liquid feed amount of the liquid feed pump 100 that are obtained by actual measurement. As shown in FIG. 8, the liquid feed amount decreases as the dissolved gas amount increases. Since there is strong corresponding relationship (correlation) between the dissolved gas amount and the natural frequency T as shown in FIG. 7, the correlation may be present even between the liquid feed amount and the natural frequency T. Thus, FIG. 9 was obtained if the relationship between the natural frequency T and the liquid feed amount that were actually measured with respect to the same dissolved gas amount is arranged. As shown in FIG. 9, strong correlation is established between the natural frequency T (in the example, the time until the fourth pulse is generated after the third pulse is generated) and the liquid feed amount. From this, it is also possible to detect the time until the fourth pulse is generated after the third pulse is generated in the detection signal DS, thereby detecting the liquid feed amount of the liquid feed pump 100. Since a decrease in the liquid feed amount originates from the factor that the liquid cannot be effectively pressurized in the pump chamber 102 due to an increase in the dissolved gas amount, it is believed that a drop in the pumping pressure also occurs along with a decrease in the liquid feed amount. Accordingly, it is also possible to detect the natural frequency T, thereby detecting the pumping pressure of the liquid feed pump 100.

As such, in the liquid feed pump 100 of the present example, the liquid feed amount or the dissolved gas amount in the liquid can be detected by measuring the time (or the natural frequency T generated after the piezoelectric element 106 is driven) from the third pulse to the fourth pulse of the detection signal DS. Since it is sufficient if the time from the third pulse to the fourth pulse of the detection signal DS or the natural frequency T (in the following, written as the natural frequency T or the like) is known, it is not necessary to measure the pressure itself. For example, the natural frequency T or the like may be measured by detecting deformation caused on the wall surfaces of the pump chamber 102, or the like, due to the vibration of the internal pressure, through an optical or electrical technique. Alternatively, the natural frequency T or the like may be measured by detecting the flow velocity change of the liquid within the outlet channel 116. For this reason, it is not necessary to separately include a flowmeter for detecting the liquid feed amount, or the like. Although a special device is required to detect the dissolved gas amount in the liquid, the dissolved gas amount in the liquid can be detected in the example, without using any special device. Since the liquid flows through the sealed channel particularly in a case where the liquid feed pump 100 is assembled and used in the circulation channel as illustrated in FIG. 6, it is not easy to detect the liquid feed amount or the dissolved gas amount. In this respect, in the example, it is possible to detect the natural frequency T or the like, thereby simply and easily detecting the liquid feed amount or the dissolved gas amount.

If the natural frequency T or the like is always monitored and the natural frequency T or the like becomes longer than a predetermined value, it may be determined that the dissolved gas amount exceeds a permissible value, or it may be determined that the liquid feed amount (or pumping pressure) of the liquid feed pump 100 falls below a permissible amount so that the control unit 152 may output a notification signal for notifying the event. Then, the operation of the liquid feed pump 100 may not be continued with deterioration in pump performance being not noticed. It is possible to perform maintenance tasks, such as replacing the liquid to be pumped or deaerating the liquid, thereby suitably operating the liquid feed pump 100. The control unit 152 in the example corresponds to a "notification signal output unit" in the invention.

In the above description, not the time from the second pulse to the third pulse of the detection signal DS but the time from the third pulse to the fourth pulse was measured. This is based on the following reasons. As shown in FIG. 1, in the liquid feed pump 100 of the present example, the pump chamber 102 is connected to the inlet-side buffer chamber 112 via the check valve 110, and if the pump chamber 102 has a negative pressure, the check valve 110 opens and the pump chamber 102 and the inlet-side buffer chamber 112 communicate with each other. Accordingly, a state where the compliance $C_1$ of the pump chamber 102 has increased sharply will be brought about, and the natural frequency T will deviate. As shown in FIG. 3B, since a period during which the pump chamber 102 has a negative pressure (a period during which the pump chamber 102 and the inlet-side buffer chamber 112 communicate with each other) is long between the second pulse and the third pulse or between the second pulse and the third pulse, an exact natural frequency T cannot be measured. In contrast, since a period during which the pump chamber 102 has a negative pressure is not generated between the third pulse and the fourth pulse (even if the period is generated, the period is merely a slight period), a value nearer to the natural frequency T can be measured. From the above reason, in the example, a value nearer to the natural frequency T is obtained by measuring the time between the third pulse and the fourth pulse of the detection signal DS. Of course, in a case where measurement accuracy is not required so much, the time between the second pulse and the third pulse of the detection signal DS may be measured. Alternatively, if attenuation in the outlet channel 116 becomes strong, the amplitude of the third wave of the pressure signal Vp becomes small. As a result, even a case where the fourth pulse of the detection signal DS is no longer generated may happen. In such a case, the time between the second pulse and the third pulse of the detection signal DS may be measured (the time between the first pulse and the second pulse may be measured depending on the case).

F. Modification Example

In the above-described example, an example in which the natural frequency T or the like is measured to detect the dissolved gas amount in the liquid or the liquid feed amount (or pumping pressure) of the liquid feed pump 100 and the notification signal is output, if necessary, has been described. However, as mentioned above with reference to FIG. 9, the liquid feed amount (or pumping pressure) of the liquid feed pump 100 decreases if the natural frequency T becomes long. Thus, the drive signal or drive frequency to be applied to the piezoelectric element 106 may be adjusted so as to compensate for a decrease in the liquid feed amount (or pumping pressure).

Figure 10:
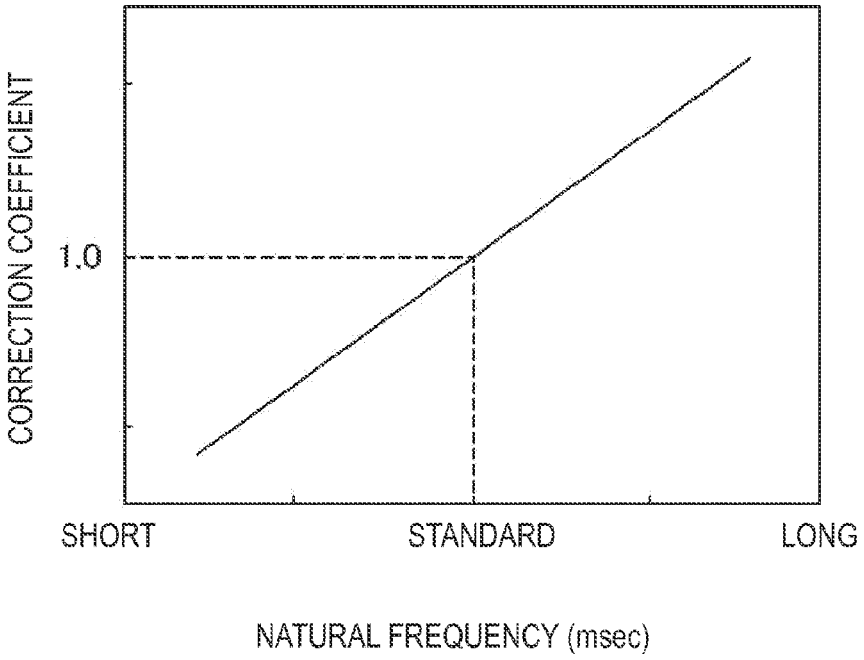
FIG. 10 is an explanatory view showing that a correction coefficient for compensating the amplitude or drive frequency of a drive signal is set according to a natural frequency.

That is, as shown in FIG. 10, the standard value of the natural frequency T or the like is set to "1.0", and correction coefficients are stored in the look-up table within the memory in the control unit 152 so that the standard value becomes larger as the natural frequency T or the like becomes longer, and the standard value becomes smaller as the natural frequency T or the like becomes shorter. If the natural frequency T or the like is measured on the basis of the detection signal DS, the control unit 152 may determine a correction coefficient corresponding to the natural frequency T or the like and may correct the amplitude of the drive signal applied to the piezoelectric element 106. For example, the amplitude of the drive waveform signal Vin to be output to produce the drive signal may be corrected depending on a correction coefficient. Then, even in a case where the dissolved gas amount in the liquid increases, it is possible to maintain a stable liquid feed amount because a decrease in the liquid feed amount (or pumping pressure) caused by the increase can be compensated for by increasing the amplitude of the drive signal.

Alternatively, the drive frequency (the number of times of drive signal output per time) of the piezoelectric element 106 may be corrected using the correction coefficient corresponding to the natural frequency T or the like. For example, the control unit 152 can correct the number of times by which the drive waveform signal Vin is output per time. Then, for example, even in a case where the dissolved gas amount in the liquid increases, it is possible to maintain a stable liquid feed amount because a decrease in the liquid feed amount caused by the increase can be compensated for by increasing the drive frequency. The control unit 152 in the modification example corresponds to a "drive signal adjustment unit" in the invention.

Although the liquid feed pump 100 of the present example has been described above, the invention is not limited to the above examples, and can be implemented in various aspects without departing from the scope of the invention.

For example, in the above-described example, an example has been described in which the pressure signal Vp is detected from the drive current Iout that flows to the piezoelectric element 106, to produce the detection signal DS. However, the invention is not limited to this, and for example, the pump chamber 102 may be provided with a pressure sensor so as to cause the pressure sensor to output a signal equivalent to the pressure signal Vp, and this signal may be converted to produce the detection signal DS. However, it is not necessary to separately provide the pressure sensor if the pressure signal Vp is detected from the drive current Iout of the piezoelectric element 106 as in the example. It is possible to obtain the pressure signal Vp simply by assembling the pressure detection unit 160 or the comparison unit 156 to the drive circuit 150 of the piezoelectric element 106.

In the above-described present example, an example has been described in which the detection signal DS is produced from the pressure signal Vp via the comparison unit 156, and the natural frequency T (time until the fourth pulse is generated after the third pulse is generated in the example) or the like is measured on the basis of the detection signal DS. However, the natural frequency T or the like may be measured on the basis of the pressure signal Vp without producing the detection signal DS.

The embodiment of the invention will be described on the basis of an application example.

Figure 11:
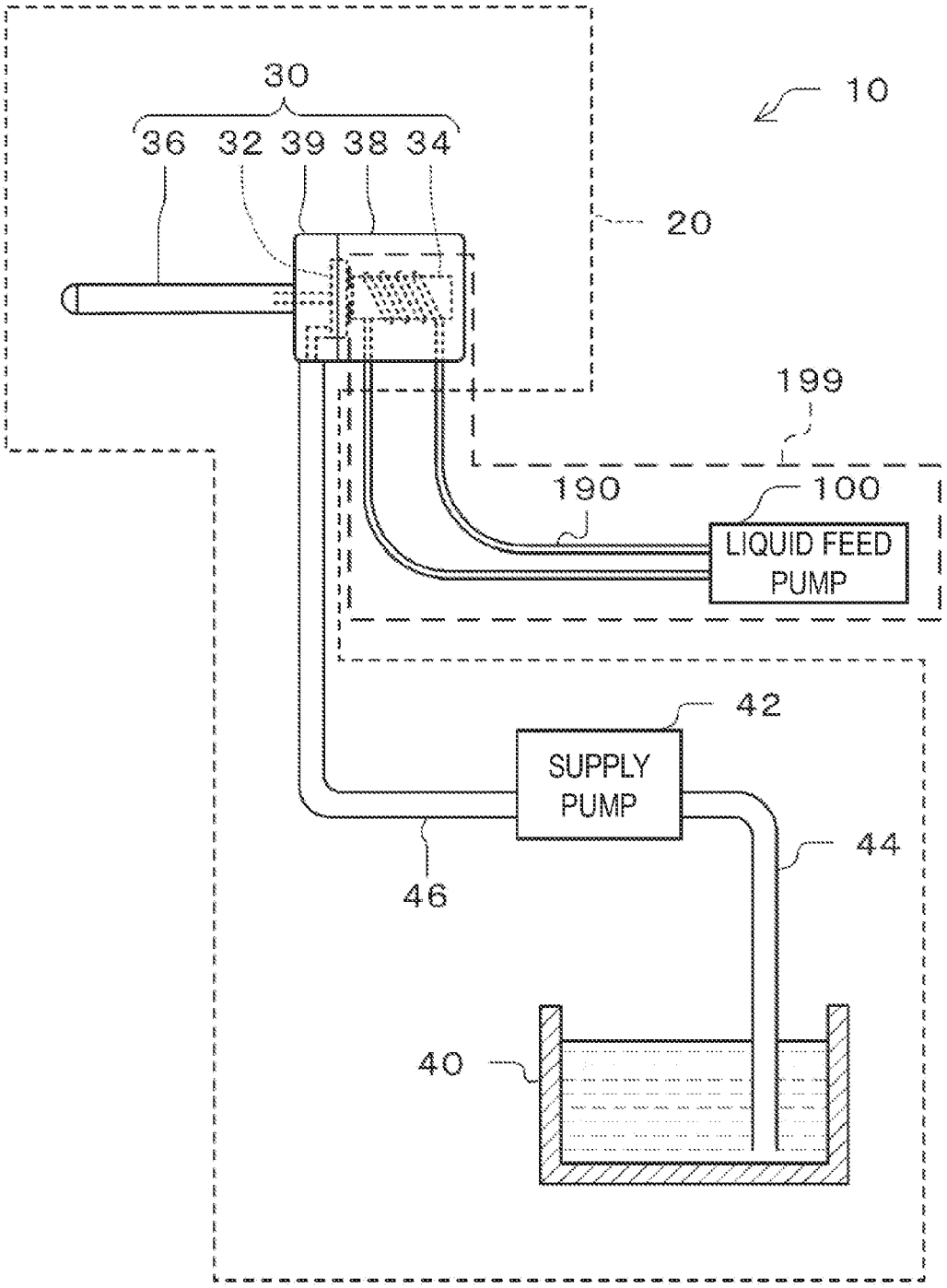
FIG. 11 is an explanatory view showing a configuration in which a liquid feed pump of the present example is applied to a circulation device of a medical device.

FIG. 11 is an explanatory view showing a schematic configuration of a fluid ejecting system 10 as an application example of the invention. In other words, FIG. 11 is an explanatory view showing a configuration in which a liquid feed pump 100 of the example is applied to a circulation device 199 of a medical device. FIG. 11 is an explanatory view showing a schematic configuration of the fluid ejecting system 10 as an application example of the invention. The fluid ejecting system 10 includes a fluid ejecting apparatus 20 and a circulation device 199 that cools the fluid ejecting apparatus 20. The fluid ejecting apparatus 20 is a water eject knife that ejects an eject stream onto a living body tissue, such as the skin, and incises and peels the living body tissue to open with shock energy therefrom. Particularly, the fluid ejecting apparatus 20 of the present example is a water eject pulse knife that intermittently or continuously ejects the eject stream.

A fluid ejecting apparatus 20 includes a pulsation generating unit 30 that ejects an eject stream, a fluid container 40 that contains water, a supply pump 42 that sucks up the water contained in the fluid container 40 and supplies the water to the pulsation generating unit 30, a connection tube 44 that connects the fluid container 40 and the supply pump 42, and a connection tube 46 that connects the supply pump 42 and the pulsation generating unit 30.

The pulsation generating unit 30 includes a fluid chamber 32 that temporarily stores the water supplied from the connection tube 46, a piezoelectric actuator 34 that applies pulsation to the water stored in the fluid chamber 32, a fluid ejection pipe 36 that communicates with the fluid chamber 32 and that allows the water to which pulsation is applied by the piezoelectric actuator 34 to pass therethrough, a lower casing 38 that accommodates the piezoelectric actuator 34 therein, and an upper casing 39 that constitutes the fluid chamber 32 and is connected to the lower casing 38.

The piezoelectric actuator 34 is a piezoelectric element and deforms a diaphragm using the piezoelectric effect of the piezoelectric element, thereby changing the volume of the fluid chamber 32. If the volume of the fluid chamber 32 becomes smaller, the water stored in the fluid chamber 32 is ejected outside as an eject stream through the fluid ejection pipe 36.

The circulation device 199 is a device that cools the piezoelectric actuator 34 of the fluid ejecting apparatus 20, and includes a liquid feed pump 100, and a liquid channel 190 that is a circulation channel of which both ends are connected to the liquid feed pump 100. The liquid channel 190 is a tube having pressure resistance and flexibility. Although medical tubes or general industrial tubes made of, for example, fluorinated resins, such as PTFE, polyimide-based resin, thermoplastic resins such as PVC-based resin, or silicone rubber, can be applied as the tube, the invention is not particularly limited thereto. The tube is wound around the piezoelectric actuator 34. For this reason, the heat generated in the piezoelectric actuator 34 is transmitted to the fluid (circulation fluid) that circulates through the interior of the liquid channel 190, thereby cooling the piezoelectric actuator 34. The circulation fluid of which the temperature has risen is cooled by air-cooling while circulating through the liquid channel 190. In addition, the circulation fluid may be separately cooled using a radiator.

Additionally, the circulation device 199 may be used in order to adjust the temperature of other medical devices other than the water eject knife. For example, the circulation device 199 may be used in order to adjust the temperature of a motor unit of a medical drill, or an ultrasonic wave generating unit of an ultrasonic scaler that removes plaque using ultrasonic waves.

Additionally, the circulation device 199 may be used not only to cool a heat-generating part, but also to heat an object. For example, the circulation device can be used in a case where a part of a human body is heated or kept warm. This can be realized by separately providing the above circulation device 199 with a heating unit that heats a circulation fluid.

Additionally, by applying the circulation device 199 to a medical device, the liquid feed pump 100 can avoid that the performance of the circulation device 199 degrades due to an increase in a dissolved gas amount in the liquid to be fed. As a result, the safety of the medical device can be enhanced by applying the circulation device 199 using the liquid feed pump 100 to the medical device.

This application claims priority to Japanese Patent Application No. 2011-199117, filed on Sep. 13, 2011 and Application No. 2011-199118, filed on Sep. 13, 2011 and Application No. 2012-140549, filed on Jun. 22, 2012, the entirety of which is hereby incorporated by reference.

What is claimed is:

1. A liquid feed pump that changes the volume of a pump chamber to pump a liquid in the pump chamber, the liquid feed pump comprising:

an outlet channel connected to the pump chamber and having the liquid flowing therethrough from the pump chamber;

an outlet-side buffer chamber having a larger compliance than the compliance of the pump chamber and having the liquid flowing therethrough from the outlet channel;

a pressure detection unit that detects the internal pressure of the pump chamber, the pressure detection unit including an integrating circuit that integrates a value of current flowing to a piezoelectric element associated with the pump chamber and a subtraction circuit that outputs an internal pressure of the pump chamber from a difference between a value that the integrating circuit outputs and a drive waveform signal, the drive waveform signal being a base of a drive signal that drives the piezoelectric element; and a comparison unit that compares the internal pressure detected in the pressure detection unit with a predetermined threshold, thereby producing and outputting a detection signal representative of an operating state of the liquid feed pump.

2. The liquid feed pump according to claim 1, further comprising the piezoelectric element that changes the volume of the pump chamber, wherein the pressure detection unit includes:

a current detection circuit that detects a current that flows to the piezoelectric element;

the integrating circuit that integrates the value that the current detection circuit outputs; and the subtraction circuit that outputs to the comparison unit the internal pressure of the pump chamber from the difference between the value that the integrating circuit integrates and outputs and the drive waveform signal that becomes the base of the drive signal that drives the piezoelectric element.

3. The liquid feed pump according to claim 1, wherein the portion of the detection signal is representative of the presence of bubbles mixed into the pump chamber, on the basis of a pressure vibration generated within the pump chamber after the volume of the pump chamber is decreased.

4. The liquid feed pump according to claim 1, wherein the portion of the detection signal is representative of a pressure under which the liquid is pumped from the liquid feed pump on the basis of a pressure vibration within the pump chamber detected after the volume of the pump chamber is decreased.

5. The liquid feed pump according to claim 1, wherein the portion of the detection signal is representative of a dissolved gas amount in the liquid on the basis of a pressure vibration within the pump chamber after the volume of the pump chamber is decreased.

6. The liquid feed pump according to claim 1, wherein the portion of the detection signal is representative of a liquid feed amount per time of the liquid on the basis of a pressure vibration within the pump chamber after the volume of the pump chamber is decreased.

7. A circulation channel system comprising:

the liquid feed pump according to claim 1;

an inlet-side buffer chamber that is connected to the pump chamber and causes the liquid to flow to the pump chamber;

an inlet channel that is connected to the inlet-side buffer chamber and causes the liquid to flow into the inlet-side buffer chamber; and a fluid channel that is connected to the inlet channel and causes the liquid fed from the outlet-side buffer chamber to flow into the inlet channel.

8. A circulation channel system comprising:

the liquid feed pump according to claim 2;

an inlet-side buffer chamber that is connected to the pump chamber and causes the liquid to flow to the pump chamber;

an inlet channel that is connected to the inlet-side buffer chamber and causes the liquid to flow into the inlet-side buffer chamber; and a fluid channel that is connected to the inlet channel and causes the liquid fed from the outlet-side buffer chamber to flow into the inlet channel.

9. A circulation channel system comprising:

the liquid feed pump according to claim 3;

an inlet-side buffer chamber that is connected to the pump chamber and causes the liquid to flow to the pump chamber;

an inlet channel that is connected to the inlet-side buffer chamber and causes the liquid to flow into the inlet-side buffer chamber; and a fluid channel that is connected to the inlet channel and causes the liquid fed from the outlet-side buffer chamber to flow into the inlet channel.

10. A liquid feed pump that changes a volume of a pump chamber to pump a liquid in the pump chamber, the liquid feed pump comprising:

an outlet channel connected to the pump chamber and having the liquid flowing therethrough from the pump chamber;

an outlet-side buffer chamber having a larger compliance than the compliance of the pump chamber and having the liquid flowing therethrough from the outlet channel; and a pressure detection unit that detects the internal pressure of the pump chamber, the pressure detection unit including an integrating circuit that integrates a value of current flowing to a piezoelectric element associated with the pump chamber and a subtraction circuit that outputs an internal pressure of the pump chamber from a difference between a value that the integrating circuit outputs and a drive waveform signal, the drive waveform signal being a base of a drive signal that drives the piezoelectric element; and a comparison unit that compares the internal pressure detected in the pressure detection unit with a predetermined threshold, thereby producing and outputting a detection signal representative of a vibration of the internal pressure detected in the pressure detection unit and a dissolved gas amount in the liquid, the detection signal having a natural frequency.

11. The liquid feed pump according to claim 10, further comprising the pressure detection unit with a current detection circuit to detect a current flowing to a piezoelectric element that changes a volume of the pump chamber.

12. A liquid feed pump that changes a volume of a pump chamber, using a piezoelectric element, to pump a liquid in the pump chamber, the liquid feed pump comprising:

an outlet channel connected to the pump chamber and having the liquid flowing therethrough from the pump chamber;

an outlet-side buffer chamber having a larger compliance than the compliance of the pump chamber and having the liquid flowing therethrough from the outlet channel; and a drive circuit configured to deliver a drive signal to a piezoelectric element to change the liquid flowing through the pump chamber, the drive circuit including:

an integrating circuit that integrates a value of current flowing to a piezoelectric element associated with the pump chamber;

a subtraction circuit that outputs an internal pressure of the pump chamber from a difference between a value that the integrating circuit outputs and a drive waveform signal, the drive waveform signal being a base of a drive signal that drives the piezoelectric element;

a comparison unit that compares the internal pressure with a predetermined threshold, thereby producing and outputting a detection signal representative of a vibration of the internal pressure detected in the pressure detection unit, the detection signal having a natural frequency; and an amplifying circuit configured to amplify a drive waveform based upon the detection signal to output the drive signal.

13. A liquid feed pump that changes the volume of a pump chamber to pump a liquid in the pump chamber, the liquid feed pump comprising:

an outlet channel connected to the pump chamber and having the liquid flowing therethrough from the pump chamber;

an outlet-side buffer chamber having a larger compliance than the compliance of the pump chamber and having the liquid flowing therethrough from the outlet channel;

a drive circuit configured to deliver a drive signal to a piezoelectric element to change the liquid flowing through the pump chamber, the drive circuit including:

an integrating circuit that integrates a value of current flowing to a piezoelectric element associated with the pump chamber;

a subtraction circuit that outputs an internal pressure of the pump chamber from a difference between a value that the integrating circuit outputs and a drive waveform signal, the drive waveform signal being a base of a drive signal that drives the piezoelectric element;

a comparison unit that compares the internal pressure with a predetermined threshold, thereby producing and outputting a detection signal representative of a vibration of the internal pressure detected in the pressure detection unit, the detection signal having a natural frequency;

an amplifying circuit configured to amplify a drive waveform based upon the detection signal to output the drive signal; and a control unit that outputs a notification signal in a case where the natural frequency exceeds a predetermined value.

14. A circulation device system comprising:

the liquid feed pump according to claim 1; and a liquid channel connected so as to feed the liquid fed from the liquid feed pump to the pump chamber.

15. A circulation device system comprising:

a liquid feed pump according to claim 2; and a liquid channel connected so as to feed the liquid fed from the liquid feed pump to the pump chamber.

16. A circulation device system comprising:

a liquid feed pump according to claim 8; and a liquid channel connected so as to feed the liquid fed from the liquid feed pump to the pump chamber.

17. A circulation device system comprising:

a liquid feed pump according to claim 9; and a liquid channel connected so as to feed the liquid fed from the liquid feed pump to the pump chamber.

* * * * *